US008177133B2

(12) United States Patent
Howard

(10) Patent No.: US 8,177,133 B2
(45) Date of Patent: May 15, 2012

(54) AIRCRAFT TARGET DISPLAY

(75) Inventor: Matthew James Howard, Blackpool (GB)

(73) Assignee: BAE Systems PLC, London (GB)

( * ) Notice: Subject to any disclaimer, the term of this patent is extended or adjusted under 35 U.S.C. 154(b) by 644 days.

(21) Appl. No.: 11/990,615

(22) PCT Filed: Aug. 16, 2006

(86) PCT No.: PCT/GB2006/050239

§ 371 (c)(1),
(2), (4) Date: Mar. 19, 2009

(87) PCT Pub. No.: WO2007/020477

PCT Pub. Date: Feb. 22, 2007

(65) Prior Publication Data

US 2009/0173789 A1 Jul. 9, 2009

(30) Foreign Application Priority Data

Aug. 17, 2005 (GB) ..... 0516998.2

(51) Int. Cl.
*G06F 19/00* (2006.01)

(52) U.S. Cl. ..... 235/412; 235/400

(58) Field of Classification Search ..... 235/400, 235/404, 407, 412; 703/8; 705/12; 89/1.56
See application file for complete search history.

(56) References Cited

U.S. PATENT DOCUMENTS 3,779,129 A * 12/1973 Lauro ..... 89/1.56
4,145,952 A 3/1979 Tye
4,312,262 A 1/1982 Tye
4,324,491 A 4/1982 Hueber
5,272,652 A * 12/1993 Rosenshein et al. ..... 703/8
5,465,212 A 11/1995 Fowler et al.
6,658,980 B1 12/2003 Hayes et al.

FOREIGN PATENT DOCUMENTS

| | | |
|---|---|---|
| DE | 3411439 | 9/1985 |
| DE | 3841197 | 6/1990 |
| EP | 0118341 | 9/1984 |
| GB | 2265444 | 9/1993 |

OTHER PUBLICATIONS

International Search Report, Jan. 2, 2007, from PCT International Patent Application No. PCT/GB2006/050239, filed Aug. 16, 2006.
U.K. Patent Office, Search Report, Nov. 3, 2005, from related UK Patent Application No. GB 0516998.2, filed Aug. 17, 2005.

* cited by examiner

*Primary Examiner* — Karl D. Frech
(74) *Attorney, Agent, or Firm* — Kenyon & Kenyon LLP

(57) ABSTRACT

A method of displaying target engageability information to a pilot of an aircraft in flight including calculating according to instantaneous aircraft position and motion relative to at least one target to be engaged and to characteristics of a weapon, earliest and latest weapon release points between which the weapon is presently capable of engaging a target of interest and generating display symbols indicating a weapon launch acceptable region and the instantaneous position of the aircraft relative thereto. A system for displaying the information and a target engageability display symbology are also described.

16 Claims, 3 Drawing Sheets

AIRCRAFT TARGET DISPLAY

RELATED APPLICATION INFORMATION

This application is a United States National Phase patent application of, and claims the benefit of, International Patent Application No. PCT/GB2006/050239 which was filed on Aug. 16, 2006, and which claims priority to British Patent Application No. 0516998.2, which was filed on Aug. 17, 2005, the disclosures of each of which are incorporated herein by reference.

FIELD OF THE INVENTION

The present invention relates to the display of targeting information to the pilot of an aircraft in flight, in particular to the display of information relating to the engagement of targets by air-to-surface weapons.

BACKGROUND INFORMATION

Conventional air-to-surface weapon delivery relies upon pre-planned flight conditions with a pre-determined weapon release point at an offset from the known and pre-defined target position. This is unnecessarily restrictive on the aircraft's freedom to alter its flight path in the light of changed circumstances. However, with the increases in computer power possible as processor technology has advanced, the need to comply with pre-planned flight conditions and approach paths has diminished; computers can now determine dynamic current flight conditions and utilize this information to continuously update the weapon release position. This ensures that the weapon is delivered on target, based on the computer's knowledge of the ballistic/airflow characteristics of the weapon.

With the development of precision and GPS-guided weaponry, the flexibility regarding where and when a weapon can be released has greatly increased. Aircraft carry more and a greater variety of different weapons, and the battlefield is becoming increasingly dynamic and volatile in nature and this increases the workload on the pilot, who needs to be able to assimilate all the various elements of targeting information and to take decisions not only on whether or not to engage a particular target but also as to the effects of the weapon's ability successfully to engage a given target in the light of past and future changes in flight path. There is a definite need for complex target engageability data to be displayed clearly to the pilot, in such a way as to be readily accessible and interpretable.

SUMMARY OF THE INVENTION

Accordingly, the present invention provides a method of displaying target engageability information to a pilot of an aircraft in flight, the method including calculating, according to instantaneous aircraft position and motion relative to at least one target to be engaged and to characteristics of a weapon, earliest and latest weapon release points between which the weapon is presently capable of engaging one or more targets of interest and generating display symbols indicating a weapon launch acceptable region and the instantaneous position of the aircraft relative thereto.

Such an arrangement provides real-time feedback to the pilot of the "degree of freedom" that exists with regard to the range to the target(s) of interest. The display, which is preferably a head up display (HUD), gives a clear indication to the pilot as to when, on the current flight path and at current flying conditions (e.g. speed), a weapon or weapons can be released and it/they will be capable of engaging the target(s) of interest. The position of the aircraft position indicator relative to the weapon launch acceptable region is a simple and easily assimilated display: if the aircraft position indicator lies within the bounds of the earliest and latest weapon release points then the pilot can see that the weapon, if released immediately, is capable of engaging the target. If the aircraft position indicator is outside the weapon launch acceptable region, either the aircraft is still approaching the target and the pilot must wait for the target to come into range before engaging the target, or the aircraft is heading away from the target and the weapon is incapable of engaging the target unless the aircraft changes its flight path back towards the target. Continuously generating a weapon launch acceptable region enables the extraction and manipulation of information so as to provide a real-time display which can be readily assimilated by the pilot in order to ease decision-making.

The method relies on knowledge of the weapon characteristics, such as its maximum and minimum ranges, turning circle, glide path, etc.

The method preferably further includes calculating, according to instantaneous aircraft direction of travel relative to at least one target to be engaged and to characteristics of a weapon, maximum lateral offset bearings such that if the aircraft flies within these bearings the weapon is capable of engaging the target of interest and generating display symbols indicating the maximum lateral offset and the instantaneous direction of travel of the aircraft relative thereto.

This provides real-time feedback of how far the aircraft is headed away from the heading to target position, with an indication as to whether or not, if the weapon were released with the aircraft on its present bearing and at its present range, it would be capable of engaging the target.

This maximum lateral offset allowance is intermixed with the weapon launch acceptable region as these are displayed in the pilot's field of view, preferably along perpendicular axes. The symbols may be displayed so as to represent the weapon launch acceptable region along the vertical axis, and the maximum lateral offset along the horizontal axis. The former is intuitively recognised by the pilot as being a plan view, with the aircraft's instantaneous direction of travel (being in the same vertical axis as the weapon launch acceptable region.) The latter is equally intuitive to the pilot, being recognised as representing the degree of freedom in relation to the maximum allowable heading away from the or each target from the pilot's visual perspective. A practical form of display is in the form of a rectangular box in the field of view of the pilot; the top and bottom horizontal edges of the box define the weapon launch acceptable region and the vertical edges define the instantaneous maximum lateral offset. The box may be aligned along a vertical axis centred in the pilot's field of view (and/or aligned with the front of the aircraft). The aircraft's instantaneous position and direction of travel relative to the box is indicated by a single symbol. To facilitate an attack, the symbol may be aligned such that it resides within this box. As the aircraft's position, direction of flight and flight conditions (e.g. altitude, airspeed) change, so does the location, size and shape of the box displayed, but provided the pilot can see that the aircraft position/direction of travel symbol lies within the box it will be readily apparent that at that moment the weapon is capable of engaging the target. Conversely, if the symbol is outside the box the pilot can readily see that the weapon is not presently capable of engaging the target, because the aircraft is too far away from/close to the target and/or the aircraft is bearing away from the target at too great an angle; thus the pilot can easily decide the appropriate action in order to engage the target: wait until the target is within range, change course, etc.

Weapon launch acceptable regions and maximum lateral offsets may be calculated for each of several targets simultaneously, with this information being amalgamated such that display symbols for each of these may be displayed simultaneously, in the manner established for a single target, in the pilot's field of view. The multiple weapon launch acceptable regions and maximum lateral offsets are amalgamated so as to generate a compound display symbol representing the regions and offsets common to at least two and preferably all of the targets, and symbols are generated representing the instantaneous aircraft position and bearing, and all of these symbols are displayed simultaneously. This provides the pilot with a display including a single compound box representing two or more targets having common instantaneous weapon launch acceptable regions and maximum lateral offsets and a single aircraft symbol. Whilst the aircraft symbol resides within the compound box the pilot can readily discern that all those targets contributing to the compound box are engageable, whereas targets whose weapon launch acceptable regions and for maximum lateral offsets do not overlap the compound box are not engageable. Likewise, if the aircraft symbol is outside the compound box, but is still within the weapon launch acceptable region and maximum lateral offset of a single target, the pilot can easily see that that target is currently engageable, but other targets are not engageable. This is discerned by reference to other specific symbols (discussed later). One of the targets displayed may be designated and displayed as the main target of interest, and the associated weapon launch acceptable region and maximum lateral offset symbols aligned within the pilot's field of view. In this way the workload on the pilot is eased, because it is readily discernible from the display and associated reference symbols whether or not the main target of interest is engageable or not, the associated symbology being displayed within the centre of the pilot's field of view. The other targets may not be as important, at that time, as the main target and therefore it is less significant that the symbology identifying these is not centred in the pilot's field of view.

In a second aspect, the invention provides a system including:

a central processing unit;

a memory coupled to the central processing unit and containing characteristics of at least one weapon for engaging a target and location data of at least one target;

aircraft position and motion sensors coupled to the central processing unit, and a head up display computer signal generator coupled to the central processing unit, the central processing unit being configured for executing the steps of:

calculating instantaneous aircraft position and motion relative to at least one target to be engaged according to aircraft position and motion data from the sensors and target location data from the memory, relating the instantaneous aircraft position and motion to weapon characteristics data from the memory, calculating earliest and latest weapon release points between which the weapon is presently capable of engaging the target and generating output signals indicative thereof to the computer signal generator, the head up display being responsive to said signals to generate display symbols indicating a weapon launch acceptable region and the instantaneous position of the aircraft relative thereto.

In a third aspect, the invention provides a target engageability display symbology for an aircraft in flight to engage at least one target with a weapon carried by the aircraft, the symbology including a weapon acceptable launch region between which, at the instantaneous aircraft position and motion relative to the target, the weapon is presently capable of engaging a target of interest and an indication of the instantaneous position of the aircraft relative thereto.

DETAILED DESCRIPTION

The present invention will now be described by way of example only and with reference to the accompanying drawings.

The present invention involves representing different "degrees of freedom" regarding where the aircraft can afford to be, prior to weapon release, if the weapon is to engage the target. This is inherently dependent on the maneuverability or flight characteristics of the weapon as well as on the position and flight conditions of the aircraft carrying the weapon.

As an aircraft approaches a target, the earliest possible weapon release point, at which the weapon is capable of engaging the target is dictated by the weapon's ability to prolong its flight path, such as by "pitching up" to induce a glide for as long as possible. The latest possible weapon release point is dictated by the weapon" ability to shorten its flight path. Between the earliest and latest possible weapon release points is a release range envelope, which is the "launch acceptable region"; whilst the aircraft is within this launch acceptable region, the weapon is capable of engaging the target.

Figure 1:
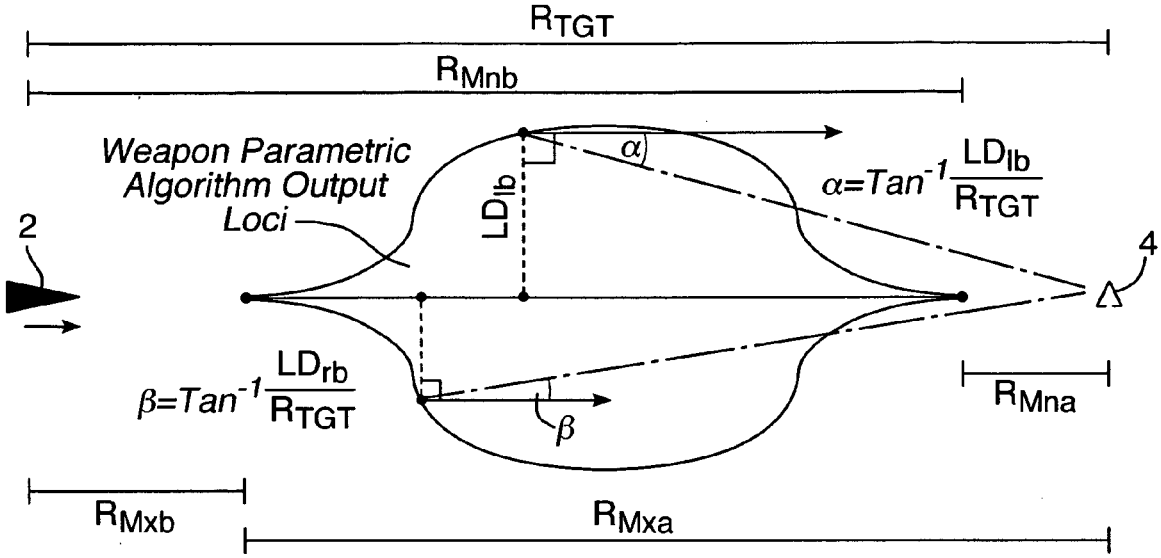
FIG. 1 is a schematic view of a weapon parametric algorithm output indicating where a weapon carried by an aircraft is capable of engaging a target which the aircraft is approaching.

The ability of the weapon to modify its flight path (away from the unguided ballistic path) is known and is modelled in software such that the launch acceptable region can be continuously generated and displayed in the cockpit. FIG. 1 illustrates how the information necessary for determining the weapon launch acceptable region is extracted by the weapon algorithm. In FIG. 1, an aircraft 2 is flying in the direction indicated by the arrow towards a target 4 and the following range variables are shown:

$R_{TGT}$=Range to target $R_{Mna}$=Minimum release range from target (aircraft's calc)

$R_{Mnb}$=Minimum release range from target (weapon's calc)

$R_{Mxa}$=Maximum release range from target (aircraft's calc)

$R_{Mxb}$=Maximum release range from target (weapon's calc)

Figure 2A:
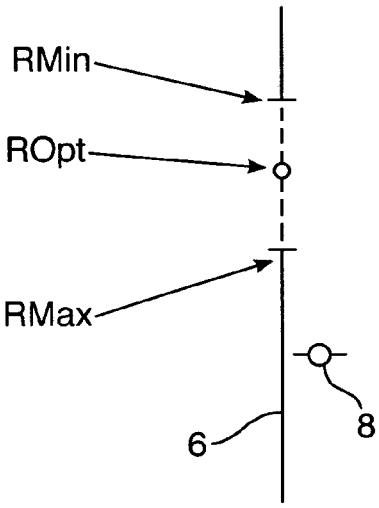
FIGS. 2*a* and 2*b* illustrate the depiction of the range degree of freedom symbology in accordance with the invention for head-up and head-down displays.
Figure 2B:
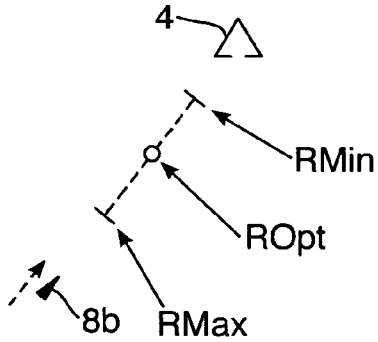

Both the point of earliest possible weapon release (i.e. maximum range, Rmax) and the point of latest possible weapon release are displayed to the pilot along a vertical axis, which the pilot must interpret with a "plan view" mindset. The range display can be in the form of a Head Up Display (HUD) (represented in the vertical axis), or a head down display (often a multi-function head-down display, MHDD). FIG. 2*a* (based on the aircraft symbol representing the aircraft located in space between the maximum/minimum ranges) and 2*b* show the symbology used for representing the range "degree of freedom" for the HUD and MHDD, respectively.

On the HUD, as shown in FIG. 2*a*, the range markers Rmax (maximum range), RMin (minimum range) and ROpt (Optimal weapon release point) move down the central, "best" steering line 6 as the aircraft approaches and eventually passes through the allowable release range "zone". When the aircraft symbol 8 is vertically-coincident with a particular range marker the aircraft is at that time located at that particular critical range from the target. The analogous arrangement applies to the MHDD display, although the aircraft symbol 8*b* differs slightly and also the target 10 is displayed.

While the aircraft is between these RMin and RMax ranges (referred to as being "in the basket") there then exists a degree of freedom with respect to how far the aircraft is headed away from the heading to target position, whilst still being able to release and have the weapon successfully reach the target. This concept is illustrated in FIG. 3.

Figure 3:
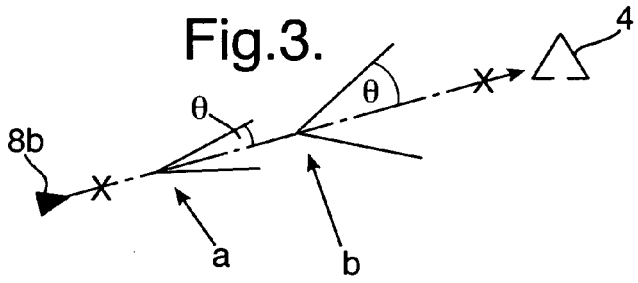
FIG. 3 is a schematic view illustrating the changing maximum allowable lateral offset for an aircraft approaching a target.

In FIG. 3 at point "a" there may exist a lateral angular deviation allowance of up to "θ" degrees away from the heading to target. As the aircraft progress toward the target further, this angular allowance may have increased. As RMin is finally approached, by the very physics and constraints of weapon maneuverability, this maximum angular allowance will have effectively "closed in" again. (Note that previous references to "α" and "β" equate to the left-hand side and right-hand side "θ" values, respectively).

Releasing with such a lateral offset would result in the weapon having to turn such that it curves back toward the target. The extent of weapon's ability to do this equates to the magnitude of this maximum allowable angle. In a very basic sense, the smaller the weapon's "turning circle", the greater this angle allowance will be.

Figure 4A:
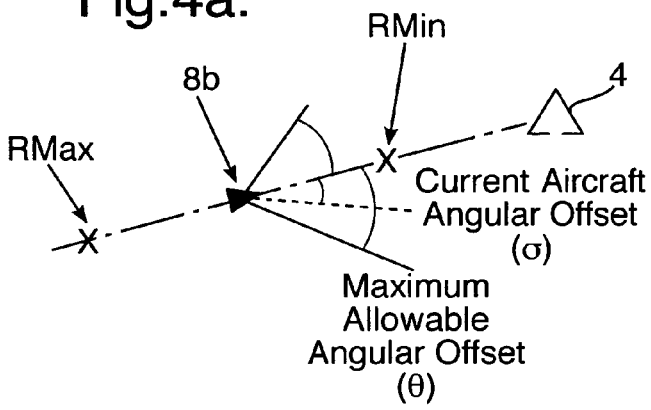
FIGS. 4*a* and 4*b* illustrate the basis and detail of the head-up symbology depiction of the current and maximum allowable offset in accordance with the invention.
Figure 4B:
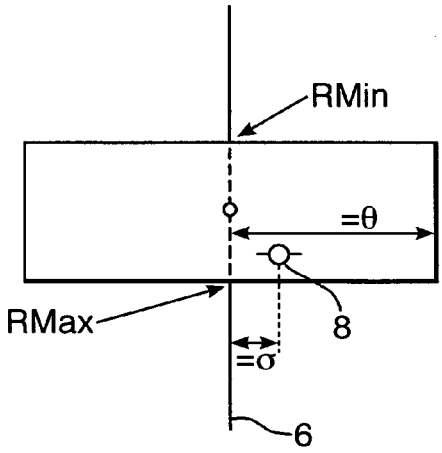

The maximum lateral angle allowance feedback is intermixed with the aforementioned range-based feedback on the HUD. It is represented in the HUD symbology suite's horizontal axis. The pilot must interpret this particular axis with an alternative "first person perspective" mindset. FIGS. 4*a* and 4*b* illustrate this. FIG. 4*a* shows the actual offsets, FIG. 4*b* shows the HUD symbology for representing lateral offset (or angular degree of freedom). When the aircraft first passes through the Rmax range, a value for "e" then exists and progressively increases. This behavior manifests itself as an effective "box" opening up from the best steering line 6. As the aircraft makes further progress toward Rmin, the value of "θ" decreases back down to zero—i.e. the box collapses completely at the point of reaching Rmin.

In both the range and angular representations, the HUD aircraft symbol 8 is used as the aiming reference point. Therefore, ensuring the aircraft is flown such the aircraft symbol 8 resides in the box just prior to release, equates to achieving a successful weapon release condition.

This simple weapon aiming task is made possible due to the fact that the current range and angular allowance information is dynamically generated—it always reflects, and is reactive to, current flight conditions such as airspeed, altitude, and pitch. For example, the maximum range (Rmax) of a weapon increases the faster the launch aircraft is travelling.

This invention is fully compliant with supporting simultaneous attack of up to 4 separate ground targets, with up to seven weapons at a time. The attack takes place as a single event at a particular time/place, and each weapon released then guides to its assigned target.

Figure 5:
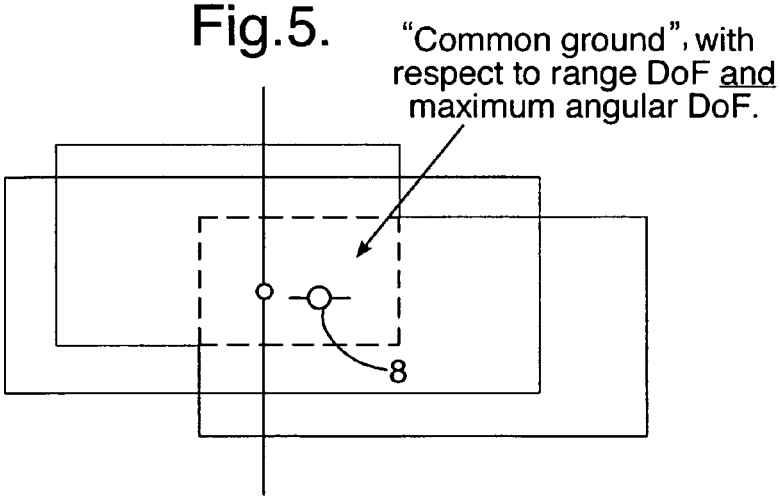
FIG. 5 shows the head-up symbology depiction of the "compound basket", a plurality of target engageability displays.

This means that the degree of freedom displayed to the pilot for such an attack must constitute common ground, so that initiation of the overall attack whilst within these degrees of freedom (i.e. with the compound basket) will result in the weapon(s) assigned to all 4 targets all being capable of reaching their destinations. This is achieved by repeating the aforementioned calculations for each individual target, and then amalgamating this information in order to derive, and consequently display, the compound basket. This is illustrated in FIG. 5, which demonstrates a simultaneous attack involving 3 targets. Initiation of the attack whilst the aircraft symbol 8 is within the compound box (shown shaded) will ensure successful attack of all 3 targets.

Outside this compound basket, a subset of the full array of targets may be engageable at any given moment, dependent on which basket(s) the a/c symbol currently resides in. This constitutes a "partial attack". Although these individual baskets are not displayed, instantaneous engageability of individual targets is reflected via separate symbology, referred to as the Ground Target List Repeater (GTLR).

To aid the pilot in the planning and execution of a complex simultaneous multiple-target attack, the GTLR provides a single point of reference for the following concisely-presented information:

- Target Identities: Which targets are involved in the oncoming attack—i.e. which targets have weapons assigned to them.
- Target Engageability: Which targets are currently engageable (and hence would have their respective assigned weapons released), if the attack were initiated instantaneously. Note that whilst inside the compound basket, by definition, all planned targets will be engageable at that moment.
- Weapon System Target of Interest: Which target is currently acting as the weapon system's target of interest—i.e. against which certain target management tasks, such as minor corrections to position, can be performed.
- Remote Aiming Point (RAP) Exploitation: Certain targets can have RAPs associated with them. RAPs aid in the process of correct positioning of targets such that weapons are delivered accurately. The GTLR depicts existence of a RAP for a given target, and indicates whether or not it is currently being exploited.
- Dynamic Weapon Delivery Feedback: Once the attack has been initiated, weapons can begin to leave the aircraft in sequence. This equates to some/all of the assigned weapons for a particular target having been released, at any particular instant throughout the attack. This partial/full engagement is depicted throughout the attack event, and engagement summarised upon completion of the attack.
- Weapon Assignment Shortfall: In instances where the desired number of weapons cannot be successfully assigned to a target, the respective target affected is indicated along with the particular reason for that assignment shortfall.

Figure 6:
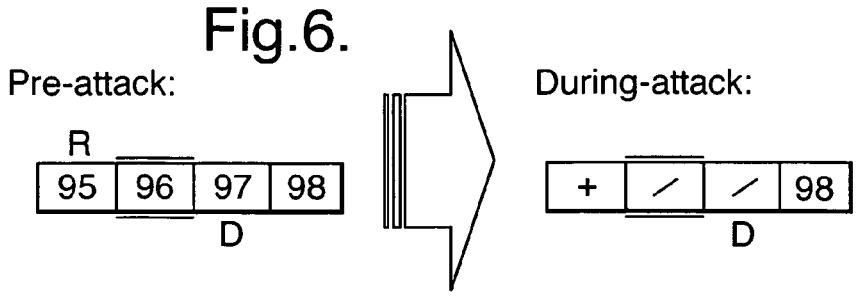
FIG. 6 shows a ground target list repeater symbology in accordance with the invention, before and during a target engagement.

FIG. 6 shows the GTLR symbology as it would be displayed (pre-attack, and during the attack).

In the FIG. 6 example, there are 4 targets planned for the imminent attack—Targets 95, 96, 97, and 98. Target 96 has 2 weapons assigned to it (and happens to be the current target of interest, hence the double border) and then Target 97 has 3 weapons assigned to it. Both Targets 95 and 98 have only one weapon assigned to them. Note that assignment quantities are indicated elsewhere in the cockpit design.

However, there is a problem with Target 97's planned assignment of 3 weapons: a weapon on the aircraft has become defective such that it is no longer useable. The planned assignment of 3 weapons can no longer be achieved, and hence only 2 weapons are actually assigned. The presence of the "D" against Target 97 indicates a problem, and identifies the nature of that problem (i.e. weapon is "D"egraded, hence less than the planned assignment is possible).

Once the attack has been initiated, the example depicts the GTLR midway through the attack. Target 95 has been engaged fully (i.e. its single assigned weapon has been released). Target 96, however, is partially attacked, as only one of the 2 weapons assigned to it has been released successfully. Target 98 has yet to have its single assigned weapon leave the aircraft. Target 97 is partially attacked (i.e. only 1 or 2 respective weapons have been released). However, it will remain partially attacked even when the overall attack event is complete, due to the fact that the planned assignment (i.e. 3 weapons) was never fulfilled. The maintained display of "D" alludes to this.

The GTLR performs distinct roles prior to, and during/after the attack event. It allows the fusion of a multitude of critical information, necessarily highly interpretable, such that situation awareness is maintained in preparation of, and throughout, complicated air-to-surface attacks.

Figure 7:
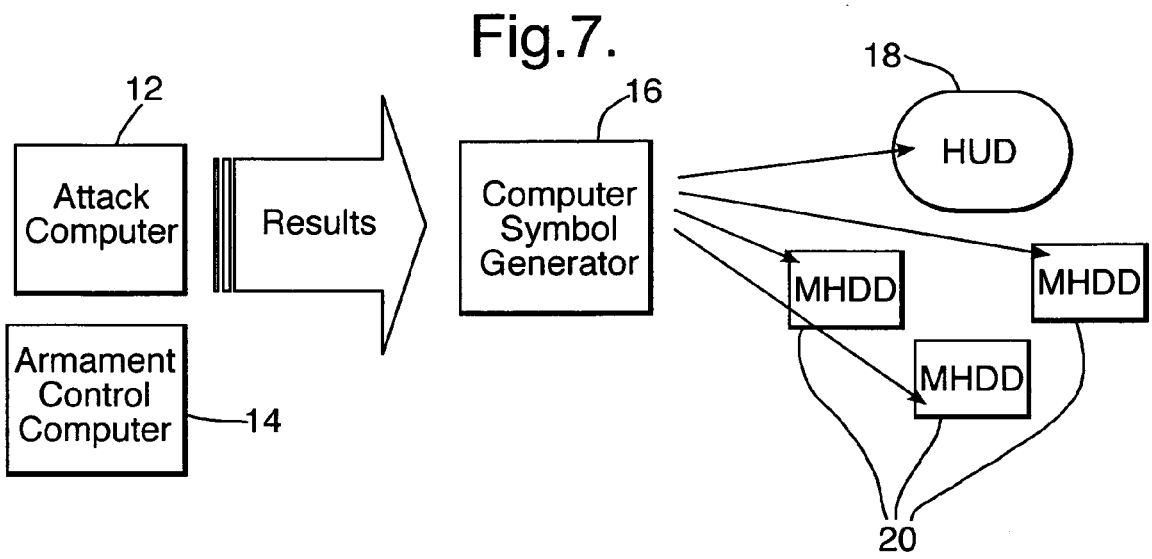
FIG. 7 is a schematic view of a system for displaying target engageability information in accordance with the invention.

In order to portray all the information described above to the pilot, it needs to first be calculated and subsequently displayed. This is all performed with the aircraft avionics system, as shown schematically in FIG. 7.

Calculations are performed by the attack computer 12 and armament control computer 14, which then use the results to instruct the computer symbol generator 16 how/where/when to display each element of the designs symbology suite. This then ultimately manifests itself on the HUD 18 and head-down displays 20.

Figure 8:
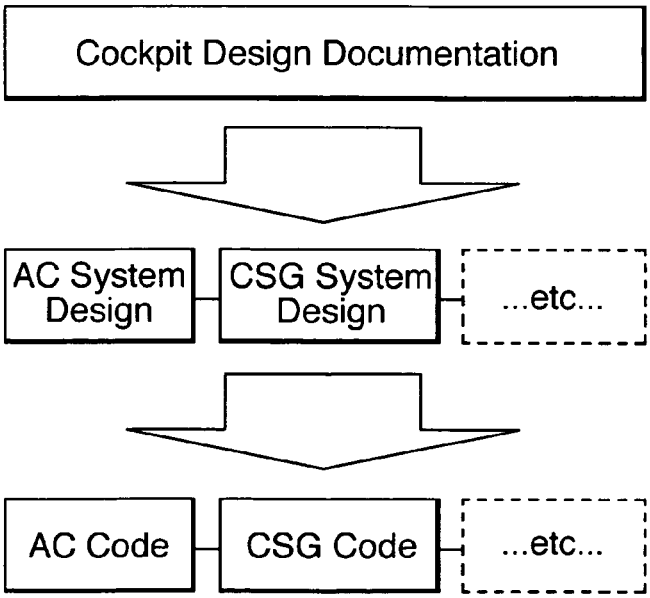
FIG. 8 is a schematic view of the software design configuration of embodiments of the system of FIG. 7.

The how, what, where of the symbology suite is defined in top-level cockpit user documentation. For this cockpit behavior to be achieved, both the Attack Computer (AC) and the Computer Symbol Generator (CSG) require reciprocated sub-system design and software code. This results in a layered definition of the design as shown in FIG. 8. The design elements are fully defined in the cockpit design documentation 22, and are embodied into sub-system design documentation and code.

The invention claimed is:

1. A method for displaying target engageability display symbology for an aircraft in flight for engaging at least one target with at least one weapon carried by the aircraft, the method comprising:

displaying a weapon launch acceptable region, an instantaneous position of the aircraft and motion relative to the target, wherein the at least one weapon is presently capable of engaging a target of interest; and displaying an indication of the instantaneous position of the aircraft relative thereto.

2. The method according to claim 1, wherein maximum lateral offset bearings are indicated such that if the aircraft flies within these bearings the at least one weapon is capable of engaging the target.

3. The method according to claim 1, wherein the instantaneous heading of the aircraft relative to maximum lateral offset headings bearings is indicated.

4. The method according to claim 1, wherein there is a symbol indicating at least one of the instantaneous position and heading of the aircraft relative to the launch acceptable region and a maximum lateral offset.

5. The method according to claim 4, wherein there are multiple targets, and wherein the symbols indicating the aircraft are aligned so as to be coincident.

6. The method according to claim 1, wherein the weapon launch acceptable region and maximum lateral offset bearings are displayed along perpendicular axes.

7. The method according to claim 6, wherein the weapon launch acceptable region is displayed along a vertical axis in a pilot's field of view.

8. The method according to claim 1, further comprising:

displaying ground target list repeater symbols which indicate at least one of: (i) the at least one target to be engaged; (ii) a status of the at least one weapon carried by the aircraft for engaging the at least one target; (iii) engageability of the at least one target; (iv) a main target of interest; and (v) a dynamic feedback of attack progress, per target, as the at least one weapon is released.

9. A method for displaying target engageability display symbology for an aircraft in flight for engaging at least one target with at least one weapon carried by the aircraft, the method comprising:

displaying a weapon acceptable launch region, an instantaneous aircraft position and motion relative to the target, wherein the at least one weapon is presently capable of engaging a target of interest;

displaying maximum offset headings, such that if the aircraft flies within these headings the weapon is capable of engaging the target; and displaying an indication of the instantaneous position of the aircraft relative to the weapon acceptable launch region and the maximum offset headings.

10. The method according to claim 9, wherein the weapon acceptable launch region and the maximum offset bearings are displayed along the vertical and horizontal axes, respectively, in a pilot's field of view.

11. The method according to claim 9, wherein a symbol indicates at least one of the instantaneous position and heading of the aircraft relative to the launch acceptable region and a maximum lateral offset.

12. The method according to claim 9, wherein the at least one target includes multiple targets and wherein the symbols indicate that the aircraft are aligned so as to be coincident.

13. The method according to claim 9, further comprising:

displaying ground target list repeater symbols which indicate at least one of: (i) the at least one target to be engaged; (ii) a status of the at least one weapon carried by the aircraft for engaging the at least one target; (iii) an engageability of the at least one target or a main target of interest; and (iv) a dynamic feedback of attack progress, per target, as the at least one weapon is released.

14. A system for displaying target engageability information to an aircraft pilot, comprising:

a central processing unit;

a memory coupled to the central processing unit and containing characteristics of at least one weapon for engaging at least one target and location data of the at least one target;

aircraft position sensors coupled to the central processing unit;

motion sensors coupled to the central processing unit; and a head up display computer signal generator coupled to the central processing unit, the central processing unit being configured for performing the following:

calculating instantaneous aircraft position and motion relative to at least one target to be engaged according to aircraft position and motion data from the sensors and target location data from the memory, relating the instantaneous aircraft position and motion to weapon characteristics data from the memory, calculating earliest and latest weapon release points between which the weapon is presently capable of engaging the target and generating output signals indicative thereof to the computer symbol generator;

wherein the head up display computer signal generator is responsive to the output signals to generate display symbols indicating a weapon launch acceptable region and the instantaneous position of the aircraft relative thereto.

15. The system according to claim 14, wherein the central processing unit is further configured for performing the following:

relating the instantaneous aircraft direction of travel relative to a target to be engaged according to aircraft position and motion data from the sensors and to target position and weapon characteristics data from the memory, and calculating maximum lateral offset bearings such that if the aircraft flies within these bearings the weapon is capable of engaging the target of interest and generating output signals indicative thereof to the computer signal generator, and wherein the head up display computer signal generator is responsive to the output signals to generate display signals indicating the maximum lateral offset and the instantaneous direction of travel of the aircraft relative thereto.

16. The system according to claim 14, further comprising:

sensors operatively connected to the memory, wherein the sensors are configured to sense the aircraft position and motion relative to the at least one target and to input this information to the memory.

* * * * *